US011447910B2

(12) United States Patent
Choi et al.

(10) Patent No.: US 11,447,910 B2
(45) Date of Patent: Sep. 20, 2022

(54) DRYER AND CONTROLLING METHOD FOR THE SAME

(71) Applicant: Samsung Electronics Co., Ltd., Suwon-si (KR)

(72) Inventors: Jungchul Choi, Suwon-si (KR); Sungmo Lee, Suwon-si (KR); Jeonghoon Kang, Suwon-si (KR); Hyungwoo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 37 days.

(21) Appl. No.: 17/011,896

(22) Filed: Sep. 3, 2020

(65) Prior Publication Data

US 2021/0062403 A1 Mar. 4, 2021

(30) Foreign Application Priority Data

Sep. 3, 2019 (KR) ..... 10-2019-0108953

(51) Int. Cl.

| | |
|---|---|
| ***F26B 13/10*** | (2006.01) |
| ***D06F 58/38*** | (2020.01) |
| ***D06F 58/46*** | (2020.01) |
| *D06F 103/04* | (2020.01) |
| *D06F 103/10* | (2020.01) |
| *D06F 105/32* | (2020.01) |
| *D06F 105/46* | (2020.01) |
| *D06F 105/56* | (2020.01) |

(52) U.S. Cl.

CPC ..... *D06F 58/38* (2020.02); *D06F 58/46* (2020.02); *D06F 2103/04* (2020.02); *D06F 2103/10* (2020.02); *D06F 2105/32* (2020.02); *D06F 2105/46* (2020.02); *D06F 2105/56* (2020.02)

(58) Field of Classification Search

CPC ..... D06F 58/38; D06F 58/46; D06F 58/48; D06F 58/30; D06F 2103/04; D06F 2103/10; D06F 2103/46; D06F 2103/02; D06F 2105/32; D06F 2105/46; D06F 2105/56; D06F 2105/00; D06F 2105/30; D06F 2105/62; Y02B 40/00

USPC ..... 34/524

See application file for complete search history.

(56) References Cited

U.S. PATENT DOCUMENTS

| | | | | |
|---|---|---|---|---|
| 8,276,293 | B2 * | 10/2012 | Ricklefs | D06F 58/30 68/5 R |
| 2008/0052950 | A1 | 3/2008 | Park et al. | |
| 2010/0236296 | A1 | 9/2010 | Choi et al. | |
| 2011/0030234 | A1 * | 2/2011 | Park | D06F 58/203 34/90 |

(Continued)

FOREIGN PATENT DOCUMENTS

| | | | |
|---|---|---|---|
| JP | 2003-181197 | A | 7/2003 |
| JP | 4973684 | B2 | 7/2012 |

(Continued)

*Primary Examiner* — John P McCormack

(57) ABSTRACT

A controlling method for a dryer is provided. The controlling method includes the steps of rotating a drum in a first direction and a second direction which is an opposite direction to the first direction by a motor, measuring the load of the motor and identifying the weight of drying materials based on the lower motor load among the load of the motor measured during rotation in the first direction and the load of the motor measured during rotation in the second direction.

20 Claims, 12 Drawing Sheets

(56) References Cited

U.S. PATENT DOCUMENTS

| | | | | |
|---|---|---|---|---|
| 2015/0104888 | A1* | 4/2015 | Lee | C23C 16/52 438/14 |
| 2018/0087208 | A1 | 3/2018 | Lee et al. | |
| 2019/0169784 | A1* | 6/2019 | Seo | D06F 58/50 |

FOREIGN PATENT DOCUMENTS

| | | | |
|---|---|---|---|
| JP | 2015-006650 | A | 1/2015 |
| JP | 2016-106294 | A | 6/2016 |
| KR | 10-0375095 | B1 | 3/2003 |
| KR | 10-0604650 | B1 | 7/2006 |
| KR | 10-2009-0017826 | A | 2/2009 |
| KR | 10-1276815 | B1 | 6/2013 |
| KR | 10-1414624 | B1 | 7/2014 |
| KR | 10-1461946 | B1 | 11/2014 |
| KR | 10-1476186 | B1 | 12/2014 |
| KR | 10-2018-0034050 | A | 4/2018 |

* cited by examiner

DRYER AND CONTROLLING METHOD FOR THE SAME

CROSS-REFERENCE TO RELATED APPLICATION

This application is based on and claims priority under 35 U.S.C. § 119(a) of a Korean patent application number 10-2019-0108953, filed on Sep. 3, 2019 in the Korean Intellectual Property Office, the disclosure of which is incorporated by reference herein in its entirety.

BACKGROUND

1. Field

The disclosure relates to a dryer and a controlling method for the same, and more particularly, to a dryer that is capable of measuring the weight of drying materials correctly, and a controlling method for the same.

2. Description of Related Art

A dryer is a device which dries drying materials by supplying hot wind of a high temperature to the inside of a drum while the drum housing drying materials such as clothes, blankets, etc. are being rotated.

On one side of a drum, a fan for circulation of air and a motor for rotating the drum are installed, and the fan and the drum are made to respectively rotate at a predetermined rotation speed from the rotation axis of the motor through transmission devices such as a pulley, a belt, etc. A rotation transmission device on the side of the drum consists of a pulley installed on the rotation axis of the motor, and a belt wound around the pulley and the outer circumferential surface of the drum in a cylindrical shape.

The dryer sequentially proceeds with a stirring process and a drying process. In the stirring process, the drum is rotated alternatingly in a clockwise direction and a counter-clockwise direction such that drying materials housed inside the drum are uniformly distributed without being tilted to one side inside the drum. When the stirring process is over, the drying process of supplying heat generated from a heater to the inside of the rotating drum through a fan proceeds, and the drying materials are thereby dried.

Meanwhile, a conventional dryer did not have a function for measuring the weight of drying materials housed inside a drum correctly, and thus a user set a drying time spent for drying materials arbitrarily and proceeded with drying. Accordingly, in case the set drying time was shorter than an appropriate drying time of drying materials, drying of drying materials was not proceeded properly, and in contrast, in case the set drying time was longer than an appropriate drying time of drying materials, there was a problem that the amount of energy consumption increased.

As can be seen above, in a dryer, measuring the weight of drying materials correctly can exert a great influence on the efficiency of drying, and thus research in this regard is being proceeded continuously.

SUMMARY

The disclosure is devised for addressing the aforementioned need, and the disclosure is in providing a dryer that measures the weight of drying materials correctly in a section wherein drying materials housed in a drum are stirred, and a controlling method for the same.

For achieving the aforementioned purpose, the disclosure provides a controlling method for a dryer including the steps of rotating a drum in a first direction and a second direction which is an opposite direction to the first direction by a motor; measuring the load of the motor; and identifying the weight of drying materials based on the lower motor load among the load of the motor measured during rotation in the first direction and the load of the motor measured during rotation in the second direction.

The rotating may comprise rotating the drum in at least two times in each of the first direction and the second direction.

The measuring the load of the motor may comprise measuring the load of the motor at least two times for each of the first direction and the second direction.

The identifying the weight may comprise determining the lower motor load by the average value or the added value of the loads of the motor measured at least two times in each of the first direction and the second direction.

The controlling method for a dryer may further comprise the steps of adjusting the drying time based on the identified weight of drying materials; rotating the drum in a rotation direction corresponding to the higher motor load among the measured motor loads; and supplying hot wind to the inside of the drum by using a fan during rotation of the motor.

The controlling method for a dryer may further comprise the steps of detecting an amount of moisture of drying materials, by an electrode detection sensor arranged inside the drum.

The controlling method for a dryer may further comprise the steps of adjusting a drying time based on a current value detected by the electrode detection sensor.

The controlling method for a dryer may further comprise the steps of identifying whether a heater is broken by comparing the lower motor load and a load of the motor measured during a drying process.

The controlling method for a dryer may further comprise the steps of identifying an error of the dryer based on the load of the motor measured during a drying process increasing.

According to another aspect of the disclosure, a controlling method for a dryer includes the steps of rotating a drum in a first direction during a predetermined time period, and rotating the drum in a second direction which is an opposite direction to the first direction during a predetermined time period; comparing the motor loads in each rotation direction measured during the drum rotated in the first and second directions and selecting a rotation direction which is measured as the lower motor load; rotating the drum, alternately, each of two or more times of first stirring sections where the drum is rotated in the first direction and two or more times of second stirring sections where the drum is rotated in the second direction; and identifying a weight of drying materials based on the motor loads measured in the two or more times of stirring sections rotating in the selected direction.

The measuring the load of the motor may comprises the motor loads measured in each of the stirring sections where the drum is rotated in the selected direction are measured at least two times.

The identifying the weight may comprise identifying the weight of drying materials by an average value or an added value of current values of the motor which are sampled at least two times.

According to another aspect of the disclosure, a dryer comprise a main body including a door, a heater arranged inside the main body, a drum rotatably arranged inside the main body, a motor driving the drum, a power transmission member that obtains power from the motor and rotates the drum in a first direction and a second direction which is an opposite direction to the first direction, a fan that obtains power from the motor and provides hot wind to the drum, and rotates in the same direction as the drum, a current detection sensor that measures the motor loads of the motor in the first and second directions; and a processor, wherein the processor is configured to measure the load of the motor while the drum is rotated in the first direction and in the second direction which is an opposition direction to the first direction by the motor, and identify the weight of drying materials based on the lower motor load among the load of the motor measured during rotation in the first direction and the load of the motor measured during rotation in the second direction.

The lower motor load includes current values of the motor which are sampled at least two times, and the processor identifies the weight of drying materials based on an average value or an added value of the current values of the motor.

The dryer may further comprise an electrode detection sensor that is arranged inside the drum and detects a current value according to an amount of moisture of drying materials.

The processor may be configured to adjust a drying time according to the progress of change of the current values detected by the electrode detection sensor.

In the stirring section where the motor load is measured to be lower among the first and second stirring sections, air flow is not generated by the fan that is driven in the same direction as the drum by the motor.

According to another aspect of the disclosure, a non-transitory computer-readable recording medium including a program for executing a method for measuring the weight of drying materials housed inside a drum of a dryer, the method comprise, rotating a drum in a first direction and a second direction which is an opposite direction to the first direction by a motor; measuring the load of the motor; and identifying the weight of drying materials based on the lower motor load among the load of the motor measured during rotation in the first direction and the load of the motor measured during rotation in the second direction.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
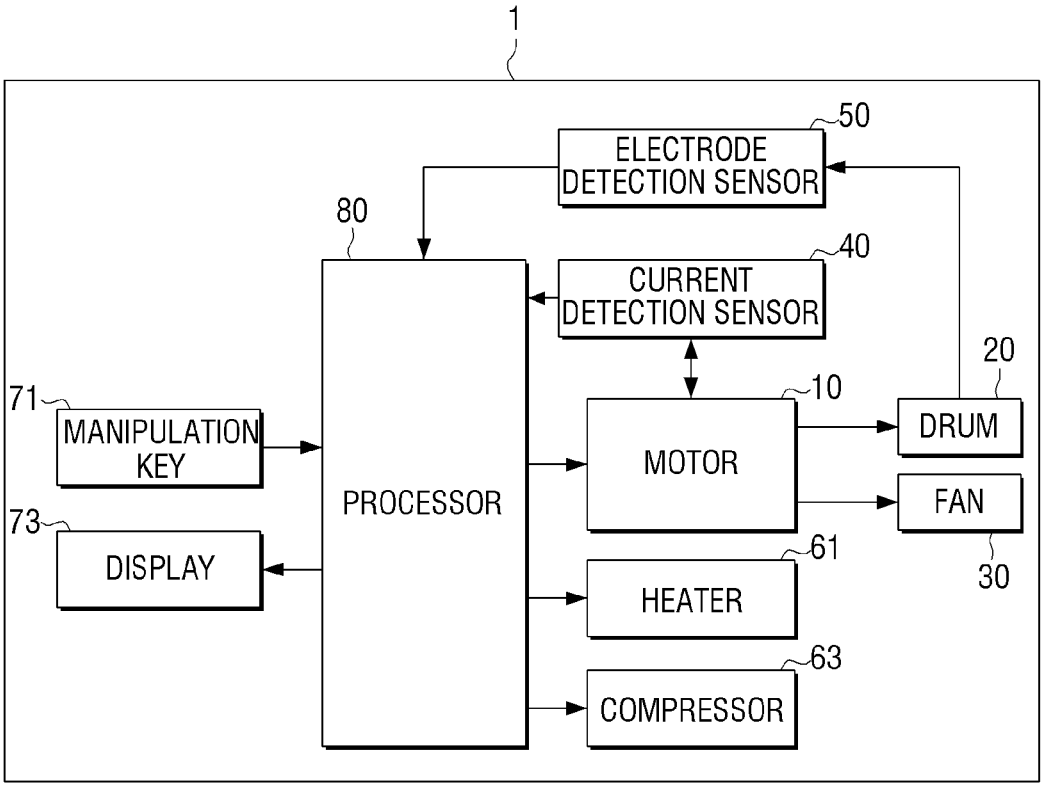
FIG. 1 is a block diagram illustrating a dryer according to an embodiment of the disclosure.

FIGS. 1 through 12, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

In explaining the disclosure, in case it is determined that detailed explanation of related known functions or features may unnecessarily confuse the gist of the disclosure, the detailed explanation will be omitted. In addition, the embodiments below may be modified in various different forms, and the scope of the technical idea of the disclosure is not limited to the embodiments below. Rather, these embodiments are provided to make the disclosure more sufficient and complete, and to fully convey the technical idea of the disclosure to those skilled in the art.

The various embodiments of the disclosure are not for limiting the technology described in the disclosure to a specific embodiment, but they should be interpreted to include various modifications, equivalents and/or alternatives of the embodiments of the disclosure. Also, with respect to the detailed description of the drawings, similar components may be designated by similar reference numerals.

The expressions "first," "second" and the like used in the disclosure may be used to describe various elements regardless of any order and/or degree of importance. Also, such expressions are used only to distinguish one element from another element, and are not intended to limit the elements.

In the disclosure, singular expressions include plural expressions as long as they do not obviously mean differently in the context. In addition, in the disclosure, terms such as "include" and "consist of" should be construed as designating that there are such characteristics, numbers, steps, operations, elements, components or a combination thereof described in the disclosure, but not as excluding in advance the existence or possibility of adding one or more of other characteristics, numbers, steps, operations, elements, components or a combination thereof.

Also, the expression "configured to" used in the disclosure may be interchangeably used with other expressions such as "suitable for," "having the capacity to," "designed to," "adapted to," "made to" and "capable of," depending on cases. Meanwhile, in the disclosure, the term "configured to" does not necessarily mean that a device is "specifically designed to" in terms of hardware. Instead, under some circumstances, the expression "a device configured to" may mean that the device "is capable of" performing an operation together with another device or component. For example, the phrase "a processor configured to perform A, B and C" may mean a dedicated processor (e.g.: an embedded processor) for performing the corresponding operations, or a generic-purpose processor (e.g.: a CPU or an application processor) that can perform the corresponding operations by executing one or more software programs stored in a memory device.

Hereinafter, a dryer according to an embodiment of the disclosure will be described with reference to the accompanying drawings.

Figure 2:
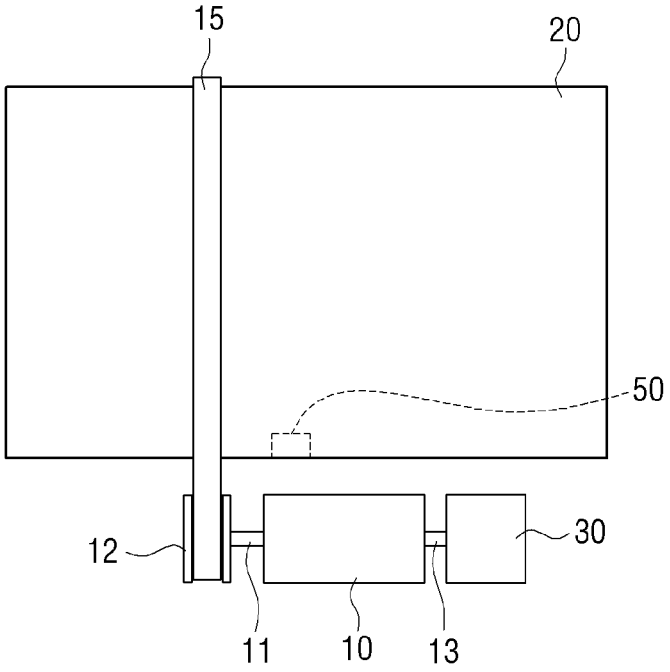
FIG. 2 is a schematic diagram illustrating an example wherein a drum and a fan of a dryer according to an embodiment of the disclosure are driven by a single motor.

FIG. 1 is a block diagram illustrating a dryer according to an embodiment of the disclosure, and FIG. 2 is a schematic diagram illustrating an example wherein a drum and a fan of a dryer according to an embodiment of the disclosure are driven by a single motor.

Referring to FIG. 1, a dryer 1 according to an embodiment of the disclosure may include a main body having a door, a drum 20 arranged to be rotatable inside the main body, a fan 30 for supplying hot wind to the inside of the drum, a motor 10 driving the drum and the fan, a current detection sensor 40 for measuring loads applied to the motor, and an electrode detection sensor 50 as a subsidiary means for figuring out the degree of drying of drying materials inside the drum.

Also, the dryer 1 according to an embodiment of the disclosure may include a heater 61 that is arranged inside the main body and generates high heat for drying, and a compressor 63. In the disclosure, the compressor 63 constitutes a heat pump cycle consisting of a condenser and an evaporator.

In addition, the dryer 1 according to an embodiment of the disclosure may include a manipulation key 71 provided on the main body for user inputs, and a display 73 showing drying situations of the dryer or various states of the dryer.

In the disclosure, it is described that the manipulation key 71 is arranged in a part of the main body, but the disclosure is not limited thereto, and the manipulation key 71 may be provided on a wireless controller. In this case, a user may perform a user input to the dryer 1 wirelessly through the manipulation key provided on the wireless controller. A user input may include input of a preset instruction that can control the operation of the dryer 1, or setting of a drying time, setting of a timer, etc. Meanwhile, in the disclosure, the display 73 may be applied as a touch screen. In this case, a user input may be performed through the display, and the manipulation key 71 may be omitted.

Also, the dryer 1 according to an embodiment of the disclosure may include a processor 80 that obtains signals from each of the current detection sensor 40, the electrode detection sensor 50, and the manipulation key 71, and can control the motor 10, the heater 61, the compressor 63, and the display 73.

Referring to FIG. 2, the drum 20 and the fan 30 may be constituted to be provided with a rotational force from one motor 10.

The motor 10 may include a first rotation axis 11 for providing a rotational force to the drum 20 and a second rotation axis 13 for providing a rotational force to the fan 30. In this case, the first and second rotation axes may be located on the same axis.

A pulley 12 coupled to the first rotation axis 11 is connected with a belt 15 surrounding the outer circumferential surface of the drum 20. The belt 15 transmits the rotational forces of the first rotation axis 11 in a clockwise direction and a counter-clockwise direction to the drum 20.

The second rotation axis 13 rotates at the same time as the first rotation axis 11 and rotates in the same direction as the rotation direction of the first rotation axis 11. To the second rotation axis 13, the fan 30 may be directly connected.

The fan 30 rotates in a clockwise direction and a counter-clockwise direction according to the rotation direction of the second rotation axis 13.

The fan 30 generates air flow for providing hot wind to the inside of the drum when it rotates in a clockwise direction and does not generate air flow when it rotates in a counter-clockwise direction according to its shape. As above, in the disclosure, it is described that the fan 30 generates air flow when rotating in a clockwise direction and does not generate air flow when rotating in a counter-clockwise direction for the convenience of explanation. However, the disclosure is not limited thereto, and the fan 30 may be constituted such that it generates air flow when rotating in a counter-clockwise direction and does not generate air flow when rotating in a clockwise direction.

Meanwhile, in case the fan 30 rotates in a clockwise direction which is the same direction as the rotation direction of the drum 20, air flow is generated by the fan 30. In this case, the current value of the motor measured by the current detection sensor 40 (hereinafter, referred to as the motor load) is expressed to be different from the motor load measured in case the fan 30 rotates in a counter-clockwise direction. That is, the motor load measured when the fan 30 rotates in a clockwise direction is bigger than the motor load measured when the fan 30 rotates in a counter-clockwise direction.

In the disclosure, from the feature of driving the drum 20 and the fan 30 together by the single motor 10, the weight of drying materials housed in the drum 20 can be measured correctly by using the feature that it is determined whether there is generation of air flow according to the rotation direction of the fan 30.

The electrode detection sensor 50 may be located in the bottom part inside the drum 20, and in the case of contact by drying materials, the electrode detection sensor 50 may measure the value of a current generated when a current is applied by water or moisture existing on the drying materials.

A current value measured by the electrode detection sensor 50 in the initial period of drying is bigger than a current value measured in the middle period of drying or the end period of drying. In addition, in case drying materials are dried, a current value measured by the electrode detection sensor 50 may be 0 or a value close to 0.

In the disclosure, in case a current value measured by the electrode detection sensor 50 is 0, it may be a basis for determining that drying materials are fully dried or in a good dried state.

Hereinafter, an example of measuring the weight of drying materials correctly through a stirring section of a dryer according to an embodiment of the disclosure will be described with reference to FIG. 3 and FIG. 4.

Figure 3:
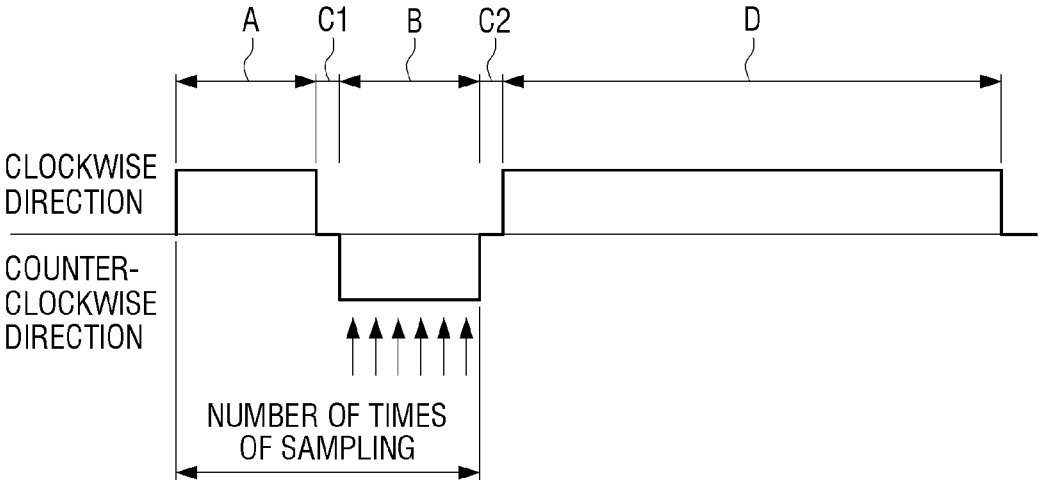
FIG. 3 is a graph illustrating rotation directions of a motor in a stirring section and a drying section according to a controlling method for a dryer according to an embodiment of the disclosure.
Figure 4:
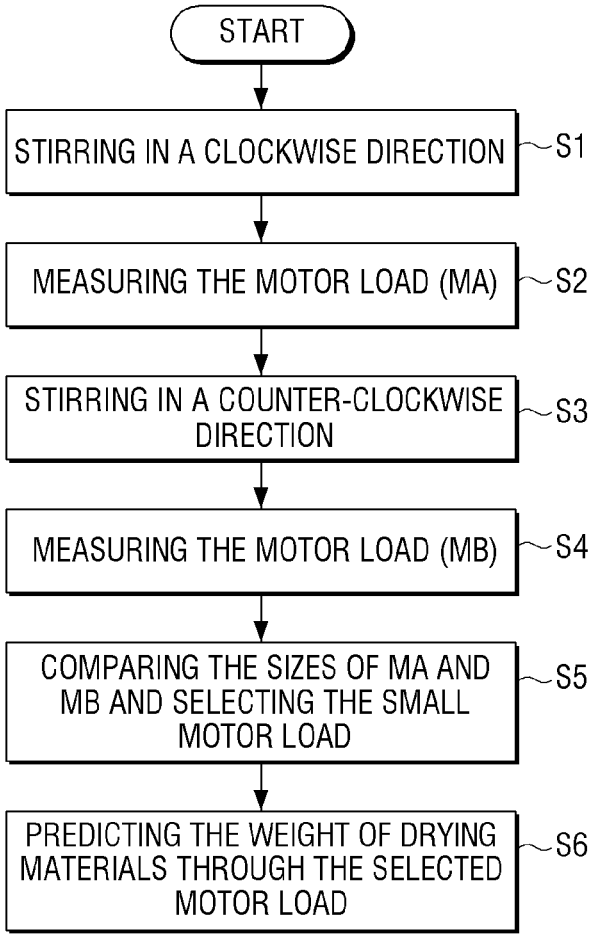
FIG. 4 illustrates a flow chart of measuring the weight of drying materials in case a stirring section in a clockwise direction and a stirring section in a counter-clockwise direction respectively exist in a stirring section as in FIG. 3.

FIG. 3 is a graph illustrating rotation directions of a motor in a stirring section and a drying section according to a controlling method for a dryer according to an embodiment of the disclosure, and FIG. 4 illustrates a flow chart of measuring the weight of drying materials in case a stirring section in a clockwise direction and a stirring section in a counter-clockwise direction respectively exist in a stirring section as in FIG. 3.

Referring to FIG. 3, the dryer 1 according to an embodiment of the disclosure distributes drying materials inside the drum through the stirring sections A, C and distributes the drying materials uniformly on the whole, and dries the drying materials by supplying hot wind to the drying materials through the drying section D.

In the stirring sections A, B, the first stirring section A is a section wherein the drum 20 is rotated at least two times in a clockwise direction, and the second stirring section B is a section wherein the drum 20 is rotated at least two times in a counter-clockwise direction.

In the first stirring section A, air flow is generated by the fan 30 rotating in a clockwise direction together with the drum 20. In this case, a current value of the motor measured by the current detection sensor 40 (hereinafter, referred to as the motor load) may be a value measured in a state wherein the weight of drying materials housed in the drum 20 and air flow generated by the fan 30 operate together.

As above, in the motor load measured in a state wherein the air flow of the fan 30 is added in addition to the weight of drying materials housed in the drum 20, the weight of the drying materials housed in the drum 20 may be expressed to be bigger than the actual weight of the drying materials.

Accordingly, for measuring the actual weight of drying materials regarding the weight of drying materials housed in the drum 20, it is desirable to measure the motor load in the second stirring section B wherein the air flow of the fan 30 does not operate.

Among the first and second stirring sections A, B, a first pause section C1 may be located for converting the rotative driving direction of the motor (converting from a clockwise direction to a counter-clockwise direction).

In the second stirring section B, the fan 30 rotates in a counter-clockwise direction together with the drum 20, and air flow is not generated by the fan 30. In this case, the weight of drying materials housed in the drum 20 can be measured correctly through the motor load measured by the current detection sensor 40.

While the motor 10 is rotatably driven in a counter-clockwise direction in the second stirring section B, the motor load may be measured by sampling the motor 10 by a predetermined number of times. By using the motor load measured by the current detection sensor 40 as above, the weight of drying materials housed in the drum 20 may be identified.

As can be seen above, in both of the first stirring section A and the second stirring section B, the drum 20 and the fan 30 rotate together in the same direction respectively according to the driving of the motor 10.

After the second stirring section B, a second pause section C2 may be located before a drying section D starts for converting to the rotative driving direction of the motor 10 (converting from a counter-clockwise direction to a clockwise direction).

In the drying section D, the heater 61 operates and generates high heat, and hot wind is supplied to the inside of the drum 20 by the fan 30 rotating together with the drum, and drying of drying materials proceeds.

Hereinafter, referring to FIG. 4, a process of measuring the motor load in a stirring section wherein air flow is not generated by the fan 30 for measuring the weight of drying materials housed inside the drum 20 will be described.

Here, a clockwise direction will be defined as a direction wherein air flow is generated by the fan 30 operating together with the drum 20, and a counter-clockwise direction will be defined as a direction wherein air flow is not generated by the fan 30 operating together with the drum 20.

The processor 80 operates the motor 10 during the first stirring section A and rotates the drum 20 in a clockwise direction a number of times (e.g., at least two times) at operation S1. In this case, the current detection sensor 40 measures the motor load generated in the motor 10 at operation S2. The measured motor load in the first stirring section may be stored in the memory.

When the first stirring section is completed, the processor 80 stops the motor 10 and goes through a specific pause period, and then rotates the drum 20 in a counter-clockwise direction a number of times (e.g., at least two times) during the second stirring section at operation S3. In this case, the current detection sensor 40 measures the motor load generated in the motor 10 at operation S4. The measured motor load in the second stirring section may be stored in the memory.

The processor 80 compares the sizes of each motor load in the first and second stirring sections stored in the memory and selects the small motor load at operation S5.

In this case, as the drum 20 rotates in a counter-clockwise direction in the second stirring section, air flow is not generated by the fan 30, and thus the motor load generated in the motor 10 is measured to be smaller than in a case wherein the drum 20 rotates in a clockwise direction.

Accordingly, the selected motor load is the motor load measured in the second stirring section.

The motor load measured in the second stirring section may be the current values of the motor sampled at least two times. The processor 80 may identify the weight of drying materials through the average or added value of these current values at operation S6.

Accordingly, in the disclosure, the exact weight of drying materials housed in the drum 20 can be predicted.

As the exact weight of drying materials is acquired as above, the drying time of the drying materials can be predicted relatively correctly.

As described above, the stirring section includes a stirring section wherein the motor 10 is rotatably driven in a clockwise direction and a stirring section wherein the motor 10 is rotatably driven in a counter-clockwise direction, and the motor load in the stirring section in a counter-clockwise direction wherein air flow is not generated may be detected.

However, in the disclosure, in case a plurality of stirring sections in a clockwise direction and a plurality of stirring sections in a counter-clockwise direction are included, the weight of drying materials can also be predicted correctly. Explanation in this regard will be made with reference to FIG. 5 and FIG. 6.

Figure 5:
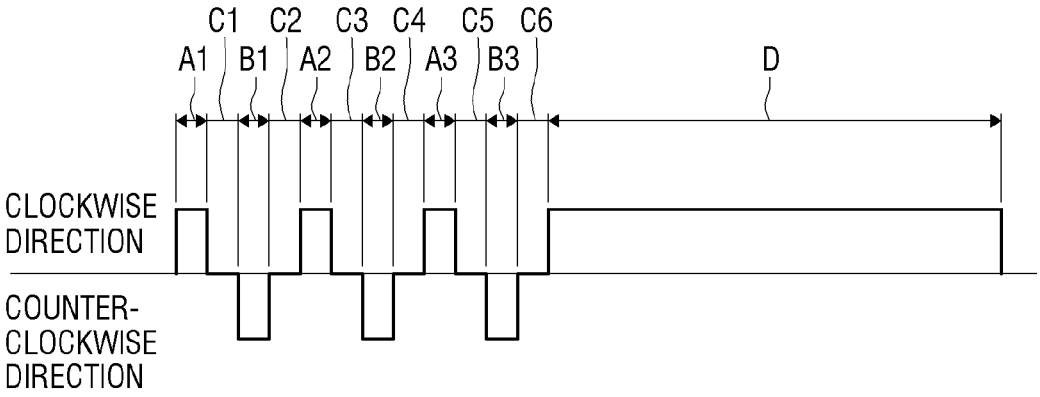
FIG. 5 is a graph illustrating rotation directions of a motor in a stirring section and a drying section according to a controlling method for a dryer according to another embodiment of the disclosure.
Figure 6:
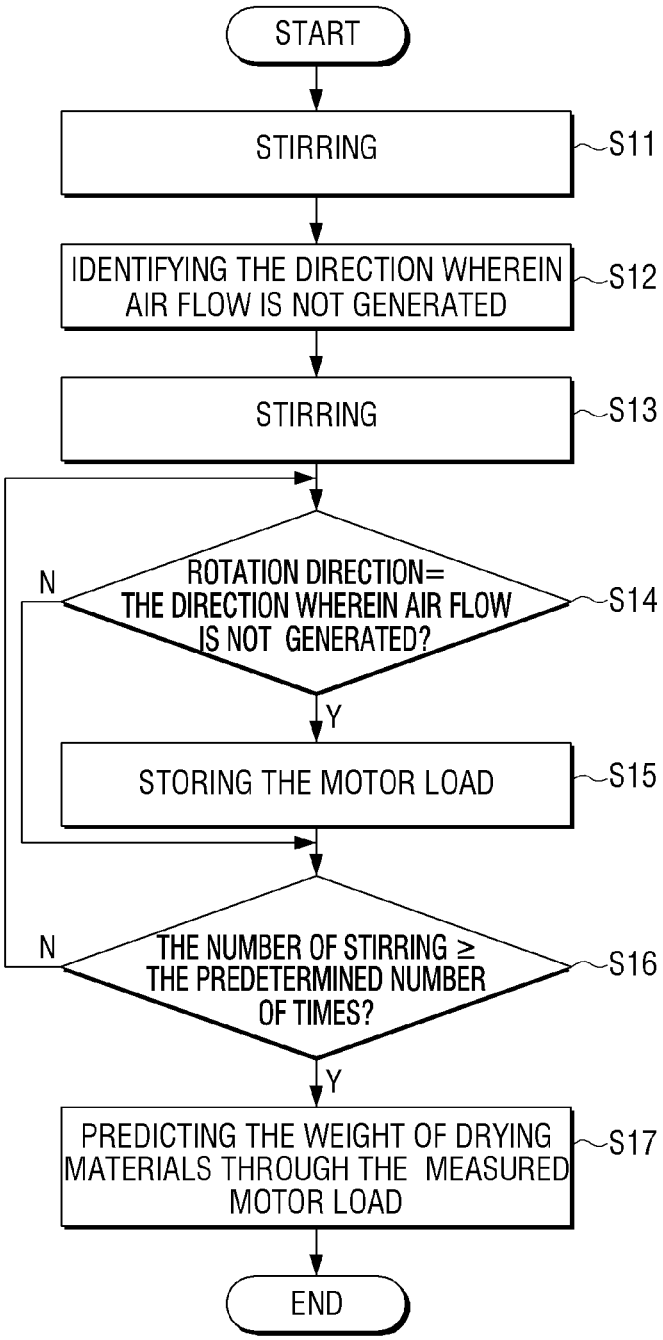
FIG. 6 illustrates a flow chart of measuring the weight of drying materials in case two or more stirring sections in a clockwise direction and two or more stirring sections in a counter-clockwise direction respectively exist in a stirring section as in FIG. 5.

FIG. 5 is a graph illustrating rotation directions of a motor in a stirring section and a drying section according to a controlling method for a dryer according to another embodiment of the disclosure, and FIG. 6 illustrates a flow chart of measuring the weight of drying materials in case two or more stirring sections in a clockwise direction and two or more stirring sections in a counter-clockwise direction respectively exist in a stirring section as in FIG. 5.

Referring to FIG. 5, in a stirring section, a plurality of stirring sections in a clockwise direction A1, A2, A3 and a plurality of stirring sections in a counter-clockwise direction B1, B2, B3 may be alternatingly located.

In this case, among each of the stirring sections A1, A2, A3, B1, B2, B3, pause sections C1, C2, C3, C4, C5 for converting the rotative driving direction of the motor 10 may be located. Also, among the last stirring section in a counter-clockwise direction B3 and the drying section D, a pause section C6 for converting the rotative driving direction of the motor 10 may be located.

If it is assumed that the number of times of sampling for measuring the currents in the stirring section in a counter-clockwise direction illustrated in FIG. 3 is nine times, the number of times of sampling for measuring the currents in the stirring sections in a counter-clockwise direction in FIG. 5 may be set as three times for each section.

In case a plurality of stirring sections in a counter-clockwise direction B1, B2, B3 are included as above, the weight of drying materials can be measured through a controlling method for a dryer according to another embodiment of the disclosure illustrated in FIG. 6.

Referring to FIG. 6, drying materials go through stirring sections sequentially rotating the drum in a clockwise direction and a counter-clockwise direction, and the drying materials are stirred at operation S11. In this case, the motor loads P1, P2 measured in each stirring section through the current detection sensor 40 are stored in the memory.

The processor 80 compares the sizes of the motor loads measured in the stirring sections and determines the direction wherein air flow by the fan 30 was not generated at operation S12. Specifically, the direction wherein the small current amount among the measured motor current values was detected (e.g., a counter-clockwise direction) is set as the direction wherein air flow is not generated by the fan 30. The small current value in this case is referred to as 'P2' for the convenience of explanation.

Then, the processor 80 drives the motor 10 and rotates the drum 20 in a clockwise direction or a counter-clockwise direction again and stirs the drying materials at operation S13, and the current detection sensor 40 measures the current value of the motor while the drum 20 rotates.

Then, the processor 80 compares the motor current value P3 measured in this stirring section and the current value of the motor P2 in the direction wherein air flow was not generated that was stored in the memory in advance, and determines whether the direction of the stirring section is the direction wherein air flow is not generated at operation S14. In addition, when the motor current value P3 measured in this stirring section is the same as or in a close range of the preset current value of the motor P2, the processor 80 stores the motor current value P3 at operation S15, and when the motor current value P3 is not the same as or in a close range of the preset current value, the processor 80 does not store the motor current value P3 in the memory.

Then, the processor 80 determines whether the number of times of stirring is greater than or equal to a predetermined number of times of stirring at operation S16.

If, as a result of determination, the number of times of stirring is smaller than the predetermined number of times of stirring, the processor 80 rotates the drum in a clockwise direction or a counter-clockwise direction again and stirs the drying materials at operation S13. Meanwhile, when the number of times of stirring is greater than or equal to the predetermined number of times of stirring, the processor 80 sums up the motor loads stored in the memory or identifies the average value at operation S17, and identifies the weight of the drying materials based on this.

As described above, in the disclosure, the current values measured in only each of the stirring sections in a counter-clockwise direction wherein air flow was not generated are averaged or summed up, and the weight of drying materials housed in the drum 20 can be predicted correctly based on this.

Meanwhile, in the disclosure, the progress of drying of drying materials can be figured out based on the correct weight of the drying materials obtained through the stirring sections as described above. As the progress of drying of drying materials is figured out, the drying state and the drying time of the drying materials can be predicted relatively correctly.

Hereinafter, a process of figuring out the progress of drying of drying materials based on the weight of the drying materials predicted correctly will be described.

Figure 7:
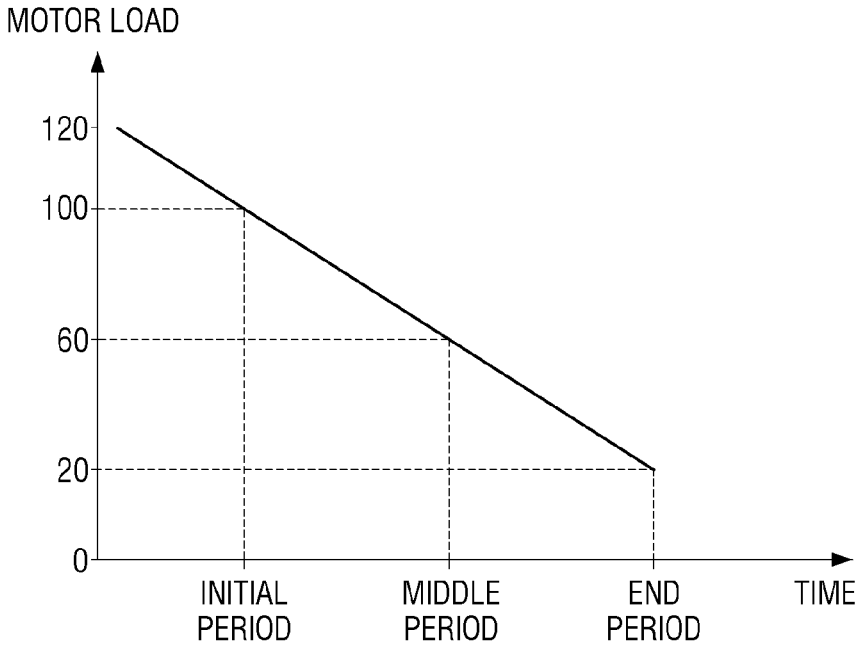
FIG. 7 is a graph illustrating the progress of drying of drying materials performed in the entire drying section.

FIG. 7 is a graph illustrating the progress of drying in the initial period, the middle period, and the end period in a drying section proceeded by a dryer according to an embodiment of the disclosure, and FIGS. 8 to 11 are flow charts illustrating a controlling method for a dryer according to an embodiment of the disclosure.

In FIG. 7, the numbers displayed along the motor load axis 20, 60, 100, 120 are examples for indicating the degree of change of motor loads generated in the motor according to the degree of drying of drying materials in the drying section.

Through the motor loads obtained through the stirring sections, the weight of the drying materials may be predicted. Also, the time spent for the drying section may be set based on the weight of the drying materials predicted through the stirring sections.

Drying proceeds as in FIG. 7, and the motor load measured in the initial period of drying may be indicated as approximately 100, the motor load measured in the middle period of drying may be indicated as approximately 60, and the motor load measured in the end period of drying may be indicated as approximately 20. In this case, the graph may be displayed as a tilt going downward according to the proceeding direction of time. The graph illustrated in FIG. 7 may mean that drying proceeds normally.

The motor loads respectively measured in the initial period, the middle period, and the end period of drying as above are based on the correct weight of drying materials before drying, and thus the drying state can be figured out relatively correctly.

Figure 8:
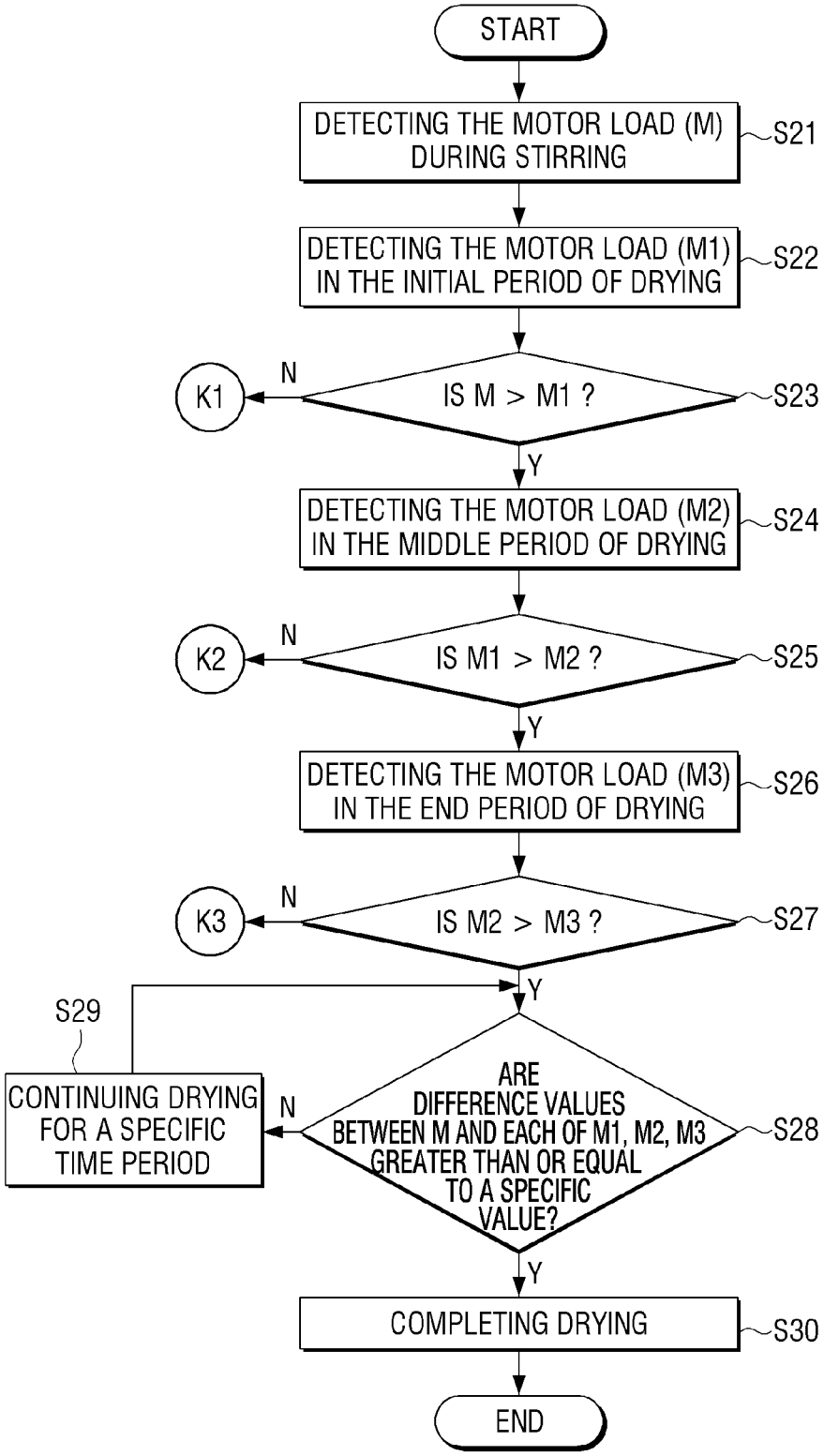
FIG. 8 is a flow chart illustrating a controlling method for a dryer according to an embodiment of the disclosure.

Referring to FIG. 8, the progress of drying of drying materials is figured out through a controlling method for a dryer according to an embodiment of the disclosure, and the drying state and the drying time can be predicted.

First, the motor load M for predicting the weight of drying materials through the aforementioned method in the stirring section is measured at operation S21.

Then, the drum 20 is rotated in a clockwise direction and hot wind is supplied to the inside of the drum 20 by the fan 30. Drying of the drying materials proceeds during a predetermined drying time, and the entire drying section may be divided into ranges arbitrarily set (i.e., the initial period of drying, the middle period of drying, the end period of drying).

In the initial period of drying, the motor load M1 of the motor 10 that is rotatably driven is measured through the current detection sensor 40 at operation S22.

The processor 80 determines whether the motor load M1 in the initial period of drying is smaller than the motor load M during stirring at operation S23. when the motor load M1 in the initial period of drying is smaller than the motor load M during stirring, drying is continued.

Figure 9:
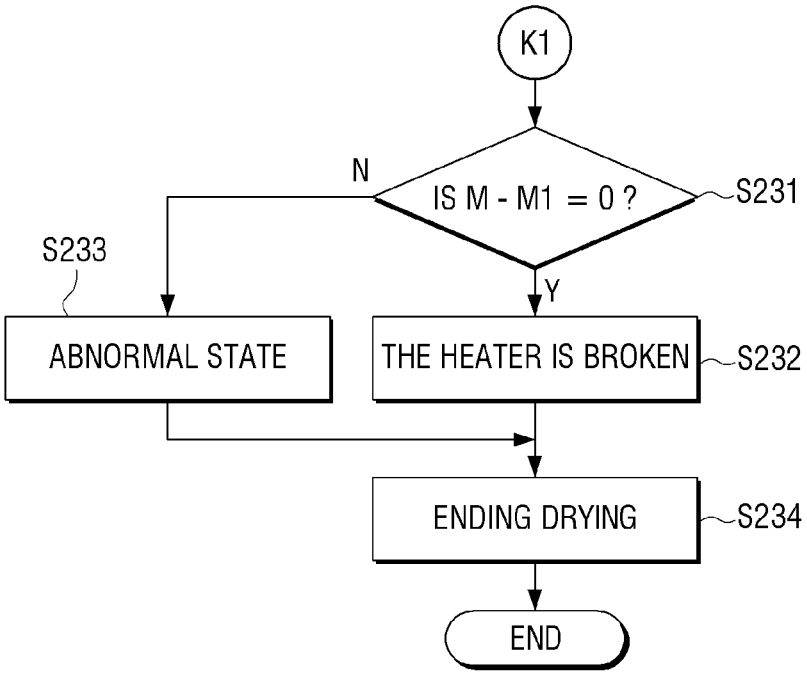
FIG. 9 is a flow chart illustrating a controlling method for a dryer according to an embodiment of the disclosure.

Referring to FIG. 9, when the motor load M1 in the initial period of drying is not smaller than the motor load M during stirring, it is determined whether the motor load M1 in the initial period of drying is the same as the motor load M during stirring (M−M1=0) at operation S231.

If the motor load M1 in the initial period of drying is the same as the motor load M during stirring, it is determined that the heater 61 is broken at operation S232 and drying is stopped at operation S234.

If the motor load M1 in the initial period of drying is not the same as the motor load M during stirring (e.g., M<M1), it is determined that the state is an abnormal state like occurrence of an error of the current detection sensor 40 at operation S233 and drying is stopped at operation S234.

Referring to FIG. 8 again, the motor load M2 of the motor 10 that is rotatably driven is measured through the current detection sensor 40 in the middle period of drying at operation S24.

The processor 80 determines whether the motor load M2 in the middle period of drying is smaller than the motor load M1 in the initial period of drying at operation S25. when the motor load M2 in the middle period of drying is smaller than the motor load M1 in the initial period of drying, drying is continued.

Figure 10:
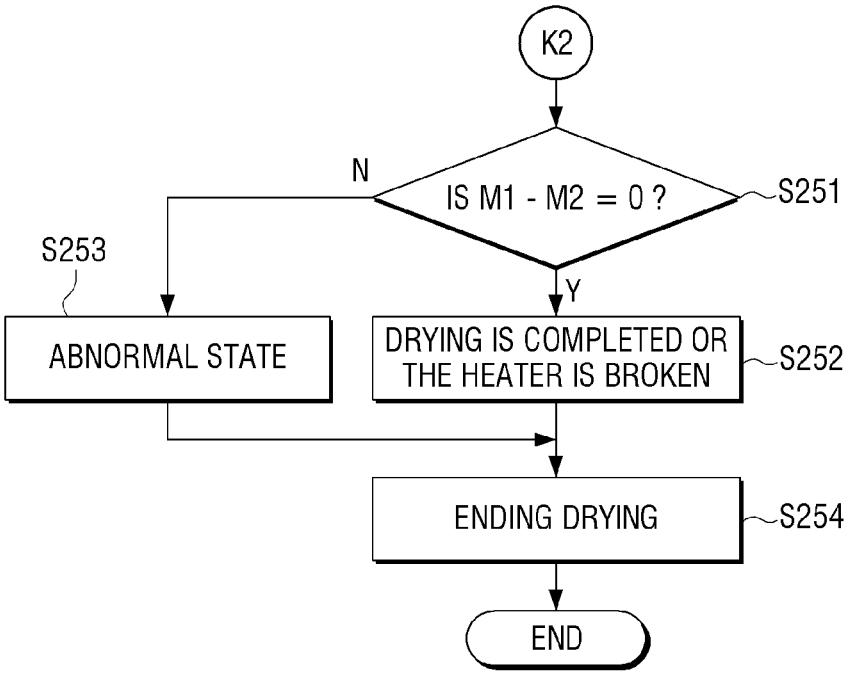
FIG. 10 is a flow chart illustrating a controlling method for a dryer according to an embodiment of the disclosure.

Referring to FIG. 10, when the motor load M2 in the middle period of drying is not smaller than the motor load M1 in the initial period of drying, it is determined whether the motor load M2 in the middle period of drying is the same as the motor load M1 in the initial period of drying (M1−M2=0) at operation S251.

If the motor load M2 in the middle period of drying is the same as the motor load M1 in the initial period of drying, it is determined that the heater 61 is broken or drying is completed at operation S252 and drying is stopped at operation S254. In case it is determined that drying is completed, drying may additionally proceed for a certain drying time depending on circumstances.

Meanwhile, when the motor load M2 in the middle period of drying is not the same as the motor load M1 in the initial period of drying (e.g., M1<M2), it is determined that the state is an abnormal state like occurrence of an error of the current detection sensor 40 at operation S253 and drying is stopped at operation S254.

In the end period of drying, the motor load M3 of the motor 10 that is rotatably driven is measured through the current detection sensor 40 at operation S26.

The processor 80 determines whether the motor load M3 in the end period of drying is smaller than the motor load M2 in the middle period of drying at operation S27. when the motor load M3 in the end period of drying is smaller than the motor load M2 in the middle period of drying, drying is continued.

Figure 11:
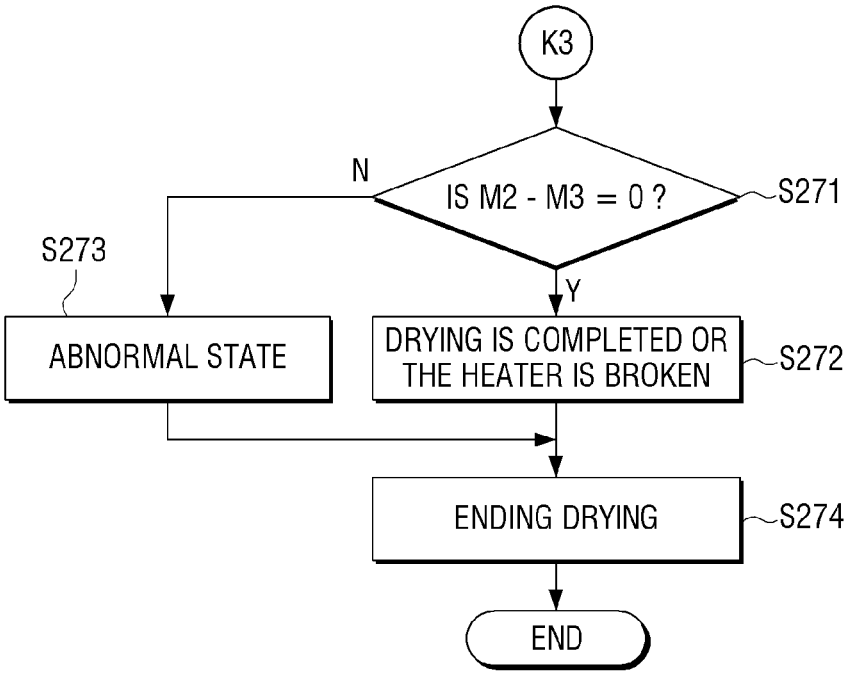
FIG. 11 is a flow chart illustrating a controlling method for a dryer according to an embodiment of the disclosure.

Referring to FIG. 11, when the motor load M3 in the end period of drying is not smaller than the motor load M2 in the middle period of drying, it is determined whether the motor load M3 in the end period of drying is the same as the motor load M2 in the middle period of drying (M2−M3=0) at operation S271.

If the motor load M3 in the end period of drying is the same as the motor load M2 in the middle period of drying, it is determined that the heater 61 is broken or drying is completed at operation S272 and drying is stopped at operation S274.

Meanwhile, when the motor load M3 in the end period of drying is not the same as the motor load M2 in the middle period of drying (e.g., M2<M3), it is determined that the state is an abnormal state like occurrence of an error of the current detection sensor 40 at operation S273 and drying is stopped at operation S274.

The processor 80 determines whether difference values between the motor load M and each of the motor loads M1, M2 and M3 are greater than or equal to a specific value at operation S28. If the difference values are not greater than or equal to a specific value, drying is continued at operation S29. Meanwhile, if the difference values are greater than or equal to a specific value, the processor determines that drying is completed at operation S30.

As described above, in the disclosure, the weight of drying materials is predicted correctly during stirring, and based on this, the progress of drying of the drying materials can be figured out through the motor loads measured respectively in the initial period, the middle period, and the end period of drying. Based on the progress of drying of the drying materials as above, the drying state of the drying materials can be figured out relatively correctly.

Also, in the disclosure, not only the progress of drying of drying materials but also whether the motor 10, the heater 61, the current detection sensor 40, etc. provided on the dryer 1 are broken during a drying process can be figured out.

Meanwhile, in the disclosure, through the current values measured at the electrode detection sensor 50 along with the progress of drying of drying materials, the drying state of the drying materials having a big volume can be figured out and an optimal drying operation can be performed. Explanation in this regard will be made with reference to FIG. 12.

Figure 12:
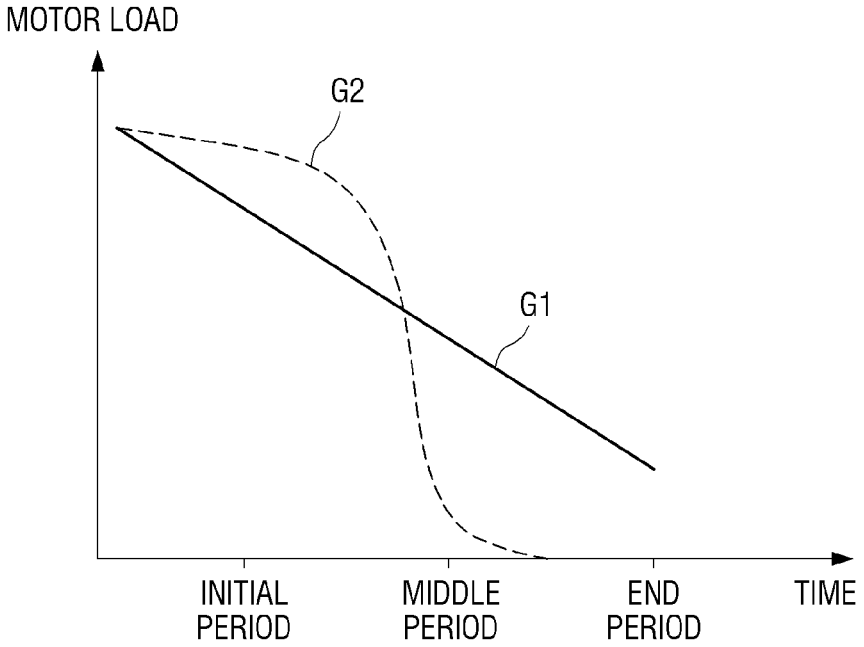
FIG. 12 is a graph illustrating the progress of drying of drying materials and current values measured at an electrode detection sensor together.

FIG. 12 is a graph illustrating the progress of drying of drying materials and current values measured at an electrode detection sensor together.

For example, in the case of blankets or clothes for winter, etc. having a big volume, the drying materials may be housed inside the drum 20 without an empty space inside the drum 20. For such drying materials having a big volume, a phenomenon that the drying materials rotate together with the rotating drum 20 occurs during a drying process, and thus the drying materials rarely move inside the drum 20.

In the case of such drying materials, the portion that contacts the electrode detection sensor 50 provided inside the drum 20 is limited to a portion of the drying materials. Here, the outer side of the drying materials means a part adjacent to the inner circumferential surface of the drum 20 while the drying materials are housed inside the drum 20, and the inner side of the drying materials means a part far from the inner circumferential surface of the drum 20.

In this case, when the drying materials are dried, the outer side is dried earlier than the inner side. Accordingly, as in FIG. 11, the current amount of the drying materials measured by the electrode detection sensor is reduced drastically as the middle period of drying passes, and a progress that the current amount becomes 0 may be shown at operation G1. Unlike this, the motor load detected by the current detection sensor 40 may show a progress of decreasing gradually at operation G2.

In this case, the processor 80 may determine that the drying materials have a big volume to a degree that the drying materials do not move inside the drum, and set an additional drying time so that the inner side of the drying materials can be dried completely.

Meanwhile, the various embodiments of the disclosure described above may be implemented in a recording medium that is readable by a computer or a device similar thereto, by using software, hardware or a combination thereof.

Specifically, programs or computer instructions for executing the method according to the aforementioned various embodiments of the disclosure may be stored in a computer-readable recording medium, more specifically, a non-transitory computer-readable medium. Such programs or computer instructions stored in a non-transitory computer-readable medium make the operations according to the aforementioned various embodiments performed by a specific machine, when they are executed by the processor of the specific machine.

A non-transitory computer-readable medium refers to a medium that stores data semi-permanently, and is readable by machines, but not a medium that stores data for a short moment such as a register, a cache, and a memory. As specific examples of a non-transitory computer-readable medium, there may be a USB, a memory card, a ROM and the like.

Although the present disclosure has been described with various embodiments, various changes and modifications may be suggested to one skilled in the art. It is intended that the present disclosure encompass such changes and modifications as fall within the scope of the appended claims.

What is claimed is:

1. A controlling method for a dryer, the method comprising:

rotating a drum in a first direction and a second direction which is an opposite direction to the first direction by a motor;

rotating a fan by the motor in a direction of rotation for the drum;

measuring a load of the motor;

determining a lower motor load based on the fan rotating in a direction that does not generate air flow; and identifying a weight of drying materials disposed in the drum based on the lower motor load.

2. The controlling method for the dryer of claim 1, wherein the rotating comprises rotating the drum at least two times in each of the first direction and the second direction.

3. The controlling method for the dryer of claim 2, wherein the measuring the load of the motor comprises measuring the load of the motor at least two times for each of the first direction and the second direction.

4. The controlling method for the dryer of claim 3, wherein the identifying the weight comprises determining the lower motor load by an average value or an added value of the loads of the motor measured at least two times in each of the first direction and the second direction.

5. The controlling method for the dryer of claim 1, further comprising:

adjusting a drying time based on the identified weight of drying materials;

rotating the drum in a rotation direction corresponding to a higher motor load among the measured motor loads; and supplying hot wind to an inside of the drum by using the fan during rotation of the motor.

6. The controlling method for the dryer of claim 1, further comprising detecting an amount of moisture of drying materials, by an electrode detection sensor arranged inside the drum.

7. The controlling method for the dryer of claim 6, further comprising adjusting a drying time based on a current value detected by the electrode detection sensor.

8. The controlling method for the dryer of claim 6, further comprising identifying whether a heater is broken by comparing the lower motor load and a load of the motor measured during a drying process.

9. The controlling method for the dryer of claim 6, further comprising identifying an error of the dryer based on a load of the motor measured during a drying process increasing.

10. A controlling method for a dryer, the method comprising:

rotating a drum in a first direction during a predetermined time period, and rotating the drum in a second direction which is an opposite direction to the first direction during a predetermined time period;

rotating a fan in a direction of rotation for the drum;

comparing motor loads in each rotation direction measured while the drum is rotated in the first and second directions and selecting a rotation direction which is measured as a lower motor load, wherein the lower motor load is based on the fan rotating in a direction that does not generate air flow;

rotating the drum, alternately, each of:

two or more times of first stirring sections where the drum is rotated in the first direction, and two or more times of second stirring sections where the drum is rotated in the second direction; and identifying a weight of drying materials based on motor loads measured in the two or more times of stirring sections rotating in the selected direction.

11. The controlling method for the dryer of claim 10, wherein, measuring the load of the motor comprises measuring the motor loads measured in each of the stirring sections where the drum is rotated in the selected direction at least two times.

12. The controlling method for the dryer of claim 11, wherein the identifying the weight comprises identifying the weight of drying materials by an average value or an added value of current values of the motor which are sampled at least two times.

13. A dryer comprising:

a main body including a door;

a heater arranged inside the main body;

a drum rotatably arranged inside the main body;

a motor configured to drive the drum;

a power transmission member configured to obtain power from the motor and rotate the drum in a first direction and a second direction which is an opposite direction to the first direction;

a fan configured to obtain power from the motor, provide hot wind to the drum, and rotate in the same direction as the drum;

a current detection sensor configured to measure motor loads of the motor in the first direction and the second direction; and a processor, wherein the processor is configured to:

measure a load of the motor while the drum is rotated in the first direction and in the second direction, determine a lower motor load based on the fan rotating in a direction that does not generate air flow, and identify a weight of drying materials based on the lower motor load among a load of the motor measured during rotation in the first direction and a load of the motor measured during rotation in the second direction.

14. The dryer of claim 13, wherein:

the lower motor load includes current values of the motor which are sampled at least two times, and the processor identifies the weight of drying materials based on an average value or an added value of the current values of the motor.

15. The dryer of claim 14, further comprising an electrode detection sensor that is arranged inside the drum and detects a current value according to an amount of moisture of drying materials.

16. The dryer of claim 15, wherein the processor is configured to adjust a drying time according to a progress of change of the current values detected by the electrode detection sensor.

17. The dryer of claim 13, wherein, in a stirring section where the motor load is measured to be lower among a first stirring section and a second stirring section, air flow is not generated by the fan that is driven in the same direction as the drum by the motor.

18. A non-transitory computer-readable recording medium including a program for executing a method for measuring a weight of drying materials housed inside a drum of a dryer, the method comprising:

rotating the drum in a first direction and a second direction which is an opposite direction to the first direction by a motor;

rotating a fan by the motor in a direction of rotation for the drum;

measuring a load of the motor;

determining a lower motor load based on the fan rotating in a direction that does not generate air flow; and identifying the weight of drying materials based on the lower motor load among the load of the motor measured during rotation in the first direction and a load of the motor measured during rotation in the second direction.

19. The non-transitory computer-readable recording medium of claim 18, wherein, for the program executing the method, the rotating of the method further comprises rotating the drum in at least two times in each of the first direction and the second direction.

20. The non-transitory computer-readable recording medium of claim 19, wherein, for the program executing the method, the measuring of the method further comprises measuring the load of the motor at least two times for each of the first direction and the second direction.

* * * * *